US005911525A

United States Patent [19]

Jepsen et al.

[11] Patent Number: 5,911,525

[45] Date of Patent: Jun. 15, 1999

[54] SIGN FRAME

[75] Inventors: J. Scott Jepsen; Bryan Aukamp, both of St. Louis County; Erin K. Price, St. Charles County; Tracy D. Ramsaroop, St. Louis County, all of Mo.

[73] Assignee: Stout Industries, Inc., St. Louis, Mo.

[21] Appl. No.: 08/835,004

[22] Filed: Apr. 27, 1997

[51] Int. Cl.[6] ..... G09F 7/02

[52] U.S. Cl. ..... 40/611; 40/649; 40/734; 40/765

[58] Field of Search ..... 40/572, 611, 649, 40/654.01, 734, 765, 782; 52/476, 477

[56] References Cited

U.S. PATENT DOCUMENTS

| | | | |
|---|---|---|---|
| 899,329 | 9/1908 | Sborigi | 40/765 |
| 1,532,865 | 4/1925 | Beck . | |
| 2,467,187 | 4/1949 | Capper . | |
| 2,941,324 | 6/1960 | Waxgiser | 40/734 X |
| 3,102,351 | 9/1963 | Howell | 40/611 |
| 3,310,901 | 3/1967 | Sarkisian . | |
| 3,955,298 | 5/1976 | Kapstad | 40/765 X |
| 4,145,828 | 3/1979 | Hillstrom . | |
| 4,519,152 | 5/1985 | Seely et al. . | |
| 4,566,211 | 1/1986 | Gustafson et al. | 40/611 X |
| 4,592,530 | 6/1986 | Seely et al. . | |
| 4,630,386 | 12/1986 | Wilson | 40/765 X |
| 4,648,169 | 3/1987 | Seely et al. . | |
| 4,783,921 | 11/1988 | George . | |
| 4,805,331 | 2/1989 | Boggess et al. | 40/611 X |
| 4,937,959 | 7/1990 | Palmer et al. . | |
| 4,958,458 | 9/1990 | Hillstrom et al. . | |
| 5,377,434 | 1/1995 | Wilson | 40/611 |
| 5,442,871 | 8/1995 | Sarkisian et al. . | |

*Primary Examiner*—Brian K. Green
*Attorney, Agent, or Firm*—Paul M. Denk

[57] ABSTRACT

An improved sign frame is provided which will allow for a sign to be quickly and easily inserted in the frame and to be easily removed from the frame. The sign frame has a first side, a second side, a third side and a fourth side. The second, third, and forth sides being formed from substantially identical elongate members which are connected together to form three sides of the frame, the elongate members are generally tubular and have a sign receiving channel to accept at least one sign and secure a stiffening member. The first side defines a sign receiving opening through which a sign is removably inserted The first side is made of a front member and a back member which are identical. The first side front and back members and the second, third and fourth side members are sized such that the two first side members are spaced apart from each other to define the sign receiving opening of the sign frame.

11 Claims, 5 Drawing Sheets

SIGN FRAME

BACKGROUND OF THE APPLICATION

This invention relates to sign frames, and in particular to a sign frame which can accept signs through one of its sides, or even its top to furnish either a slide-in or drop-in style of sign, so that the sign can be easily changed.

Signs are commonly used by stores to promote various products or to display information regarding the product. Oftentimes, the sign will be contained in a frame. Obviously, it is desirable to periodically change the sign to update the information contained therein or to promote a different product. It is desirable that the frame provide for easy access to the sign contained therein so that the sign may be easily and quickly changed.

As an example of an illustrative embodiment of prior art style of sign frame, related to this invention, reference is made to FIG. 1. The sign frame, of this earlier style, includes a bottom, having sides, and a top, wherein the frame 1 is made of three types of members, including a bottom member, forming a base, the top and bottom frames appended thereto, a connected right side of the frame, while the left side of the frame is made up of two parts, to provide clearance intermediate thereof, and through which the various signage may be inserted, during its installation. As further shown in FIG. 1. the frame may accept the sign's S1 and S2, and a stiffening member S3, through the left side frame, so that such signage can be disclosed within the framework of the sign, once they are fully slid into location.

SUMMARY OF THE INVENTION

One object of the present invention is to provide an improved sign frame.

Another object is to provide such a frame which allows for quick and easy changing of the sign contained therein.

Another object is to provide such a frame wherein the sign can be changed without the need to disassemble the frame.

Another object of this invention is to have a permanent image "locked" in place which is not easily removed and resists forces from nature and vandalism. This image is easily covered with temporary or permanent insert graphics.

These and other objects will become more apparent to those skilled in the art in light of the following disclosure and accompanying drawings.

In accordance with the invention, generally stated, an improved sign frame is provided which will allow for a sign to be quickly and easily inserted in the frame and to be easily removed from the frame. The sign frame has a first side, a second side, a third side and a fourth side. The second, third, and forth sides being formed from substantially identical elongate members which are connected together to form three sides of the frame, the elongate members are generally tubular and have a sign receiving channel to accept at least one sign, and perhaps, a stiffening member. The first side defines a sign receiving opening through which a sign is removably inserted The first side is made of a front member and a back member which are identical. The first side front and back members and the second, third and fourth side members are sized such that the two first side members are spaced apart from each other to define the sign receiving opening of the sign frame.

The members each have connector receiving channels formed therein. Angled connectors are insertable into the connector receiving channels to fixedly connect the frame members together. The connectors have a first leg which is received in one member and a second leg which is received in a second member. The connector legs each have a barb, the barb and the connector receiving channels being sized such that the connector is forced fit in the connector receiving channel.

In one aspect of the invention, the second, third, and fourth side members each have a base, sides extending from the base, and an inner structural face extending between the sides. A first pair of spaced apart elongate ribs extend up from the base to define the sign receiving channel. The face has an elongate opening aligned with the sign receiving channel to admit the sign through the member. The side which defines the bottom of the sign frame may have a footing to enable the sign to stand atop a surface. This bottom member includes flanges extending outwardly from the first pair of ribs towards the sides. The second, third, and fourth side members each have a second pair of ribs spaced interiorly from the member sides. The second pair of ribs include a bottom rib extending upwardly from the base and an upper rib extending downwardly from the front. The bottom and upper ribs are coplanar with each other, and, in combination with the side, define the connector receiving channel. The face of the second, third, and fourth members includes a first portion which is generally parallel to the base and a second portion which extends inwardly from an end of the first portion and away from the base. The second, third, and fourth members have an axis of symmetry which divides the members into a front half and a back half. The first side members have a base, a side extending from the base, and a face portion extending from the side, the base, side, and face of the first side member being substantially identical to one-half of the first, second, and third side members.

In another aspect of the invention, the members which make up the second, third, and fourth sides of the frame have a base, sides extending from the base, and an inner structural face. An elongate central beam extends from the base and an elongate tube is on a top surface of the beam. The tube has a longitudinal opening to define a generally C-shaped channel which faces away from the base. Spaced apart surfaces extend from the tube generally perpendicularly to the base and define the sign receiving channel. The front of the member extends from the member sides to the spaced apart surfaces and has an elongate opening therein, through the member's face, and which opens into the sign receiving channel. This sign includes a stiffening member which has a tubular bead at a base thereof and a plate extending from the bead. The bead is sized to be received in the C-shaped channel and the plate extends out of the C-shaped channel, through the sign receiving channel, and the face. The stiffening member divides the sign receiving channel into a front channel and a back channel, each of the channels being sized to receive a sign. Thus, the frame can receive and display two signs which face away from each other.

In another aspect of the invention, the frame is wall mountable. The wall mountable sign frame is made from substantially identical elongate members which are connected to define a first, second, and third side of the frame. A fourth side of the frame is opened to removably accept the sign. The member includes a base which is adapted to be secured to a wall, an outer side extending from the base, a front extending from the outer side, and an inner side extending inwardly from the front. A front flange and a back flange extend from the outer side and are spaced apart to define a sign receiving channel. The inner side extends toward the ledges and has a free end spaced forwardly of the first flange. The first flange is shorter than the second flange. Preferably, An arm extends from the outer side and the first and second flanges are connected to the arm.

DESCRIPTION OF THE PREFERRED EMBODIMENT

Figure 1:
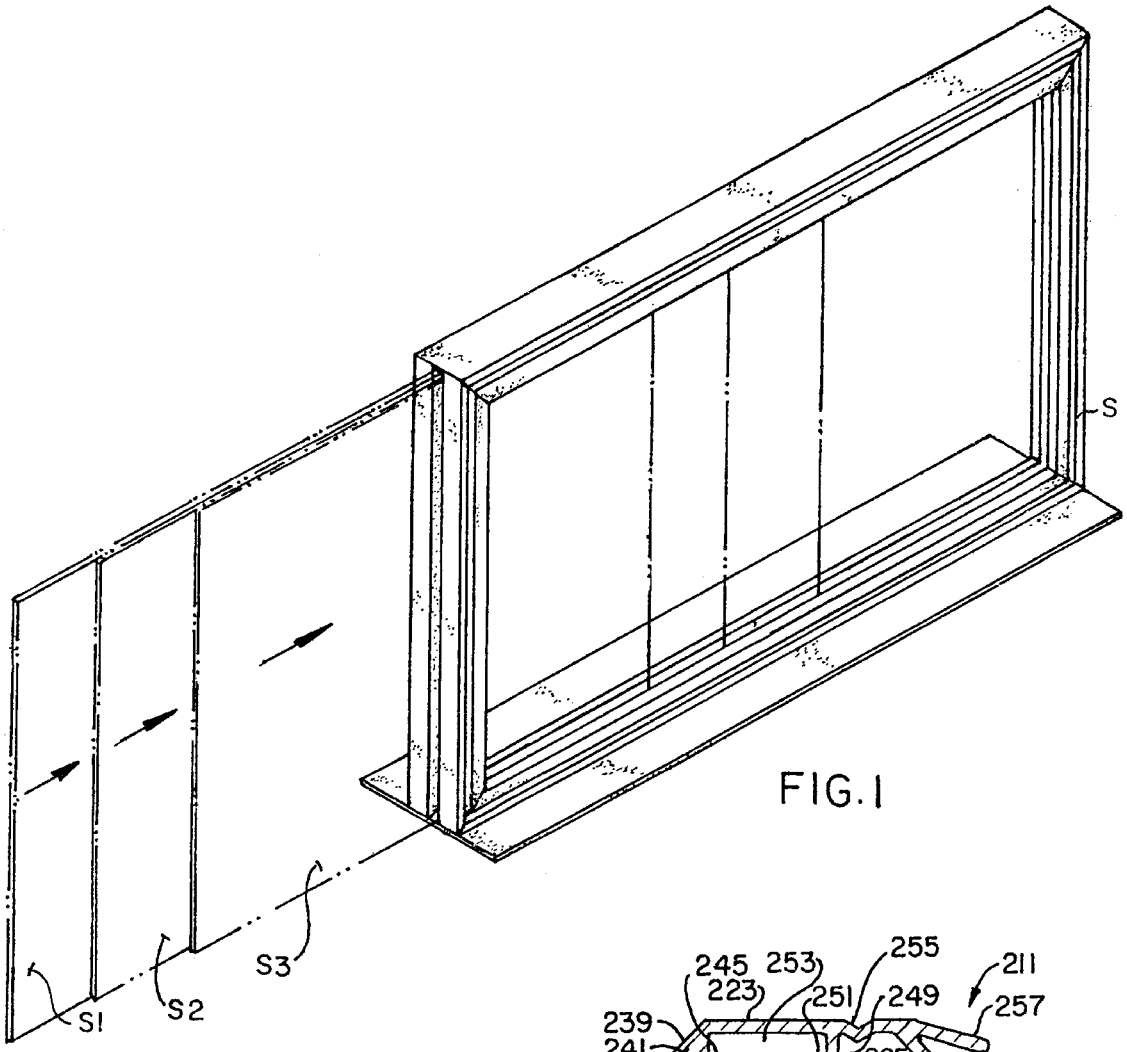
FIG. 1 is a perspective view of a prior art embodiment of a sign frame, the signs being shown in phantom.
Figure 1A:
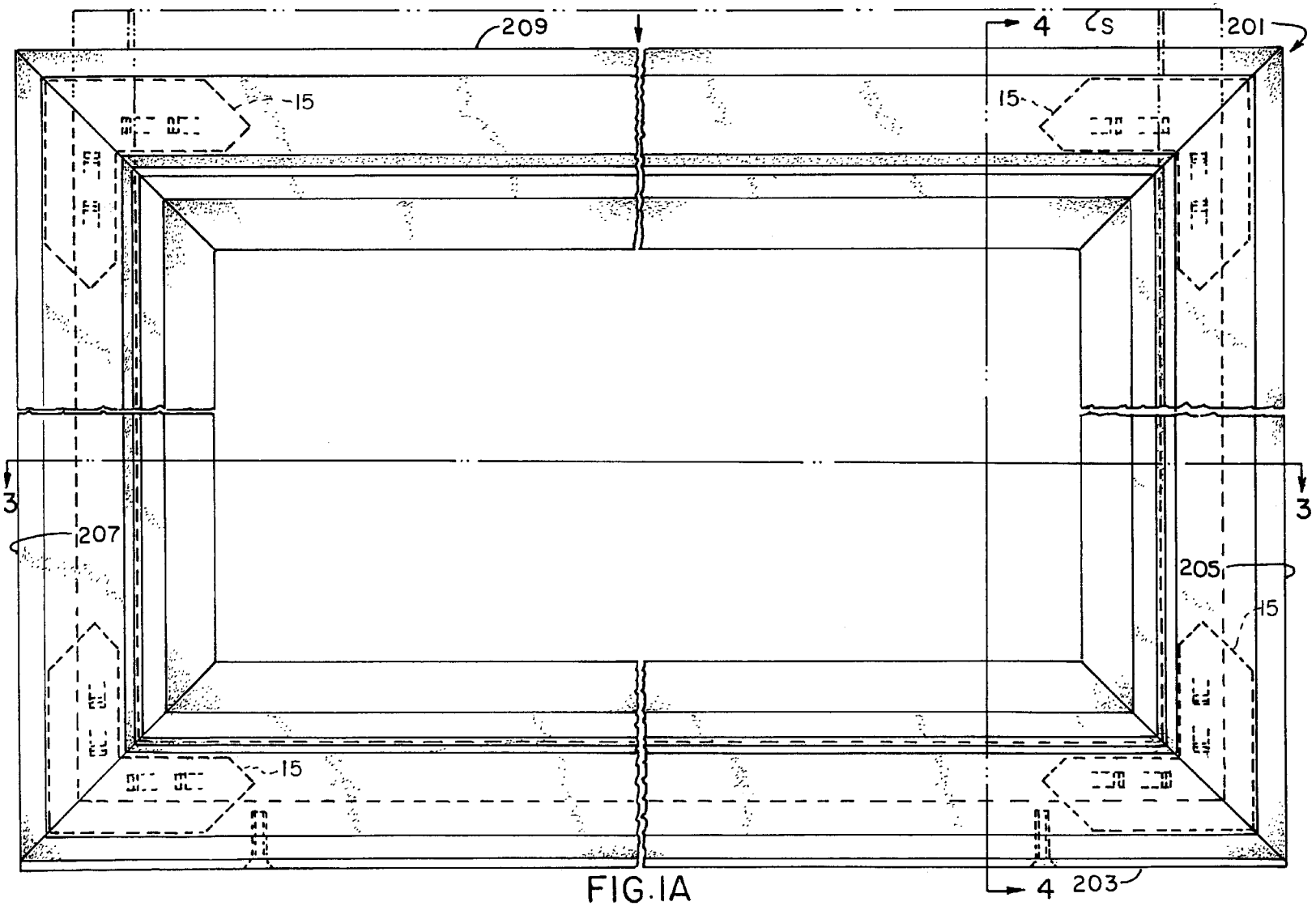
FIG. 1A is a plan view of the frame, of this current invention, made with alternative side members configured to accept a sign through its top and showing the connecting members in phantom.
Figure 3:
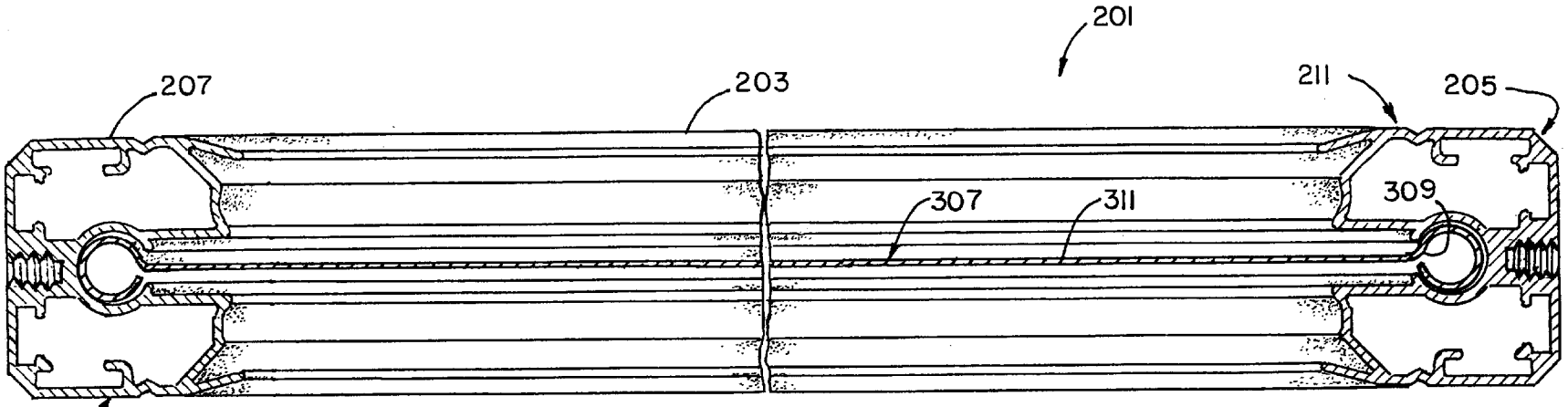
FIG. 3 is a cross-sectional view of the frame taken along line 3—3 of FIG. 1A.
Figure 2:
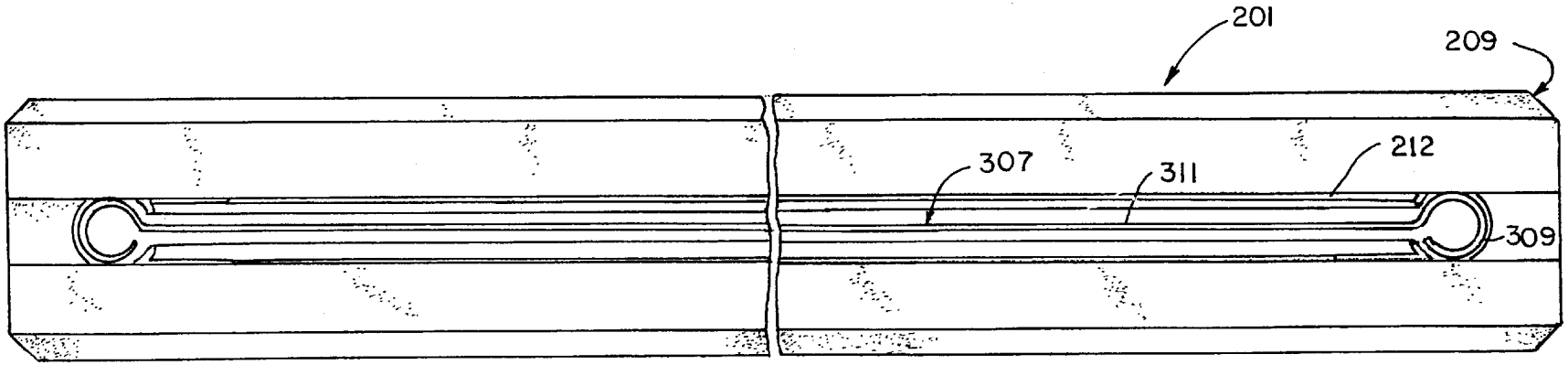
FIG. 2 is a top plan view of the frame of this invention.
Figure 5:
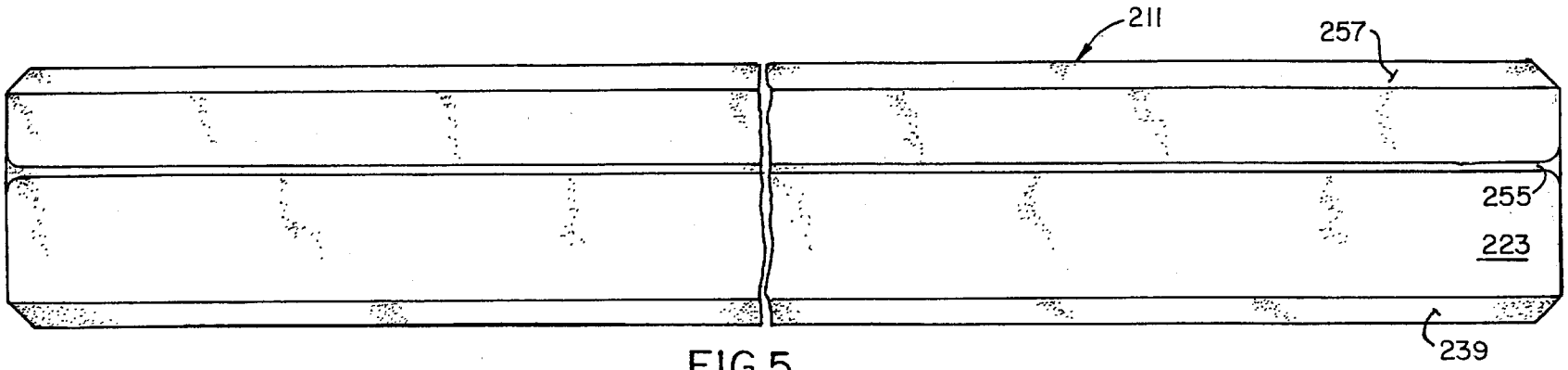
FIG. 5 is a side elevational view of a frame member used to make the frame of FIG. 1A FIGS. 6A and B are cross-sectional views of the frame members used to make the frame of FIG. 1A.
Figure 4:
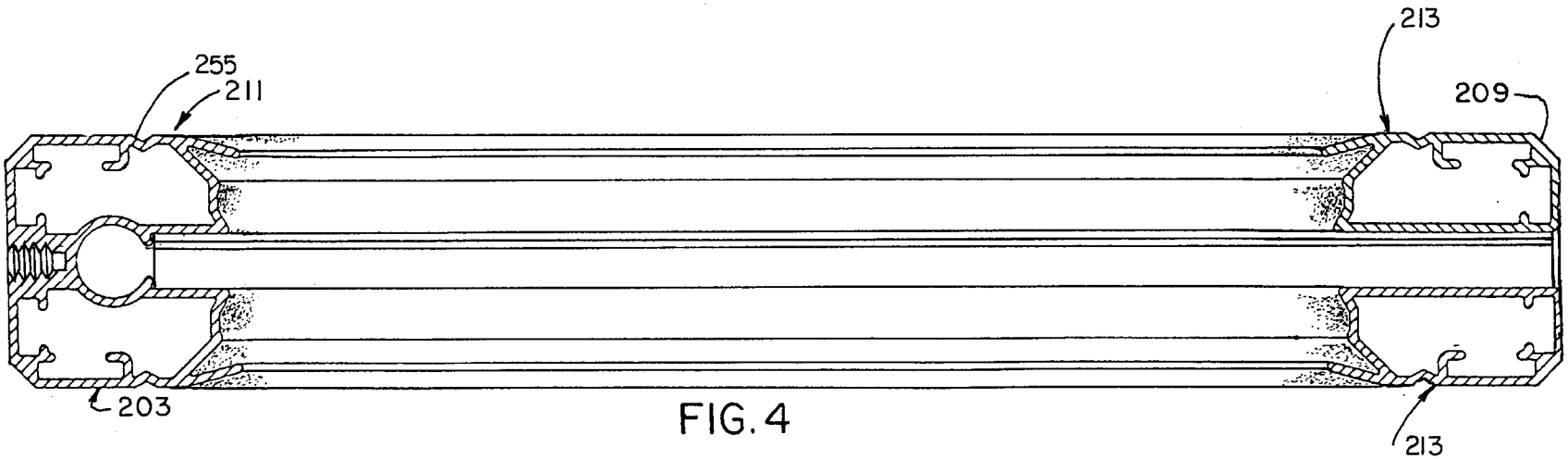
FIG. 4 is a cross-sectional view of the frame taken along line 4—4 of FIG. 1A.

The primary embodiment of this particular invention is shown in FIGS. 1A, 2 and 3, and it comprises the structure of a frame 201, as noted. The frame 201, which is shown generally in these Figures includes a bottom 203, sides 205 and 207, and a top 209. The frame 201 is adapted to receive a sign S through the top 209, and the top thus forms a sign receiving opening 211. As can be understood from the discussion to follow, the sign receiving opening could be formed in either of the sides 205 or 207, or even in the bottom 203 (although placing the opening in the bottom is not preferred). The sign frame 201 is made of two different members which are cut to length and connected using connectors 15 to form the frame 201. The first member 211 forms the bottom and sides of the frame 201, and the second member 213 forms the side having the sign receiving opening 212 (the top 209 of sign 201).

Figure 6B:
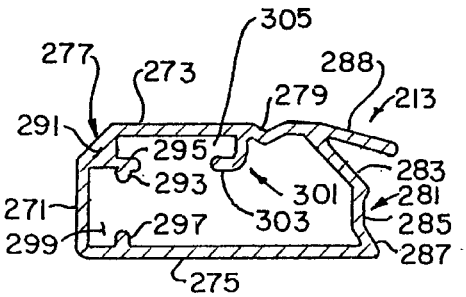
Figure 6A:
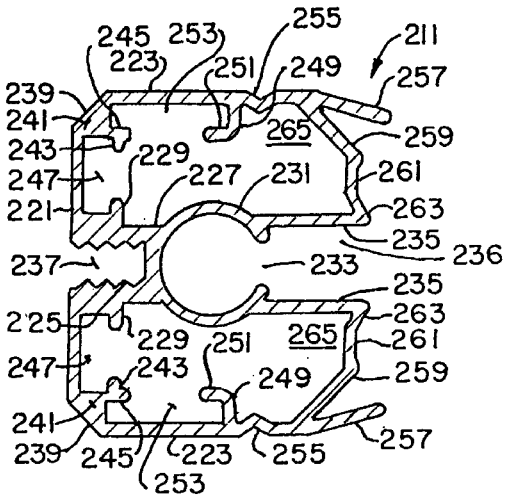

The member 211 from which the bottom 203, and sides 205 and 207 are made is shown in detail in FIG. 6A. The member 211 includes a base 221 having side walls 223 extending generally perpendicularly from the base. A center beam 225 extends up from the inner surface of the base 221 generally centered between the two sides 223. The beam is stepped inwardly to form a narrower beam 227 above beam 225. A flange or rib 229 extends outwardly from the top of the beam 225 towards the sides 223. A "C" shaped channel 231 is formed on the top of the beam 227 and has an opening 233 which faces outwardly, away from the base 221. Beams 235 extend outwardly from the outer surface of the channel 231, again, away from the base 221. The beams 235 are spaced slightly from the edges of the channel 231. The space 236 between the beams 235 defines a sign receiving channel in the members 211. Bolt holes 237 can be formed periodically along the outer surface of the base 221. The bolt holes 237 extend through the first beam 225 and into the second beam 227, and are provided to secure the frame to a surface. The surface can either be the top of a cabinet, or if L-brackets or clips are used, a wall, or to a base to form a surface support, as known in the art. (See FIG. 1)

The corners 239 between the base 221 and the side walls 223 are preferably chamfered. A triangular bead 241 is formed inside the comers 239 and include a pair of ribs 243 and 245 which are perpendicular to each other. The rib 243 is directed toward, and co-planar (co-linear) with the rib 229. The ribs 243 and 229, with the inner surface of the base 221, form a channel 247.

Upwardly (or outwardly) of the rib 245, an L-shaped rib 249 extends inwardly from the inner surface of the side 223. The rib 249 has a finger 251 which faces and is co-planar (colinear) with the rib 245. The ribs 249 and 245, with the inner surface of sides 223, form a channel 253. As will be described below, the channel 253 receives the connector 15 to assemble the frame 201.

Outwardly of the rib 249, a V-shaped groove 255 is formed in the side 223. A sloping surface 257 extends inwardly and away from the end of the side wall 223. At the intersection of the side wall 221 and the sloped surface 257, another sloped surface 259 extends inwardly, somewhat toward the beams 235. A surface 261, which is generally parallel to the base 221 extends inwardly from the surface 259, and a small sloped portion 263 extends from the end of the surface 261 to the end of the beam 235. The surfaces 259, and 261, form what are defined herein as the inner face for these members. Thus, the base 221, side 223, surfaces 259 and 261, beam 235, channel 231, and beams 227 and 225 also define an enclosed space 265.

The member 213, which is used to form the sign receiving side of the frame, is shown in cross-section in FIG. 6B. The member 213 is less than half the width of the member 211, and two members 213 are used together to form the sign receiving side of the sign frame. The member 213 includes a base having an outer side 273 and an inner side 275 extending generally perpendicularly from opposite ends of the base. The inner side 275 is generally planar. The corner 277 connecting the base 271 and side 273 is chamfered, and the side 273 has a V-shaped groove 279 formed therein. A surface 281 extends between the tops of the sides 275 and 273. The inner side 275 is longer than the outer side 273, thus the surface 281 includes a first portion 283 extending from the top of side 273 away from the base 271 and towards the side 275. A generally horizontal portion 285 extends from the sloped portion 283, and a short sloped section 287 connects the horizontal portion 285 to the side 275. A surface 288 extends outwardly from the end of side 273 and is sloped generally toward the side 275. The surface 288 corresponds to the surface 257 of the member 211. The base 271, side 273, and surfaces 283, 285, and 287 are identical in shape to the corresponding surfaces of the member 211. The base 271 has a length which extends from the corner 239 of the member 211 to the inner surface of the upper beam 227 of the member 211, and the outer surface of the side 275 is generally aligned with the surface of the beam 227.

Internally, the member 213 has a bead 291 at the comer 277 and two perpendicular ribs 293 and 295. The side 275 has a rib 297 which is co-planar with the rib 293, and the two ribs 293 and 295, in conjunction with the base 271, define a channel 299 which corresponds to the channel 247 of the member 211. An L-shaped rib 301 extends inwardly from the side 273 adjacent the groove 279. The rib 301 has a finger 303 which faces and is co-planar with the rib 295. The ribs 295 and 301 and the side 273 define a second channel 305 which corresponds to the channel 253 of the member 211, and which also accepts a connector 15 during assembly.

To assemble the frame 201, three sides are formed from the member 211, and two pieces are cut to length from the member 213 to form the sign receiving side of the frame 201. Obviously, the ends of each piece are mitered, as shown. The connecting members 15 are received in the connector receiving channels 253 of the members 211 and the three sides of the frame 201 are assembled together. Prior to placing the members 213 on the partially assembled frame, a stiffener 307 is placed in the frame. The stiffener 307 has a circular bead 309 and a plate 311 which extends from the bead. The bead 309 is received in the C-channel 231 and the plate extends out of the opening 233 to the C-channel 231 and toward the opposite side of the frame. The stiffener 307 may extend the full length of the frame and has a bead at each end which is received in the C-channels of the opposing side members. Alternatively, two separate stiffeners may be used, the plates of which are less than one-half the length of the frame, so as not to interfere with each other. Or, a stiffener with a bead only at one end may be used. Once the stiffener 307 is in place, the members 213 can be applied to the partially assembled frame to complete the frame. The sign is then simply slid into the frame between the two members 213. One sign may be placed on each side of the stiffener 307.

Figure 7:
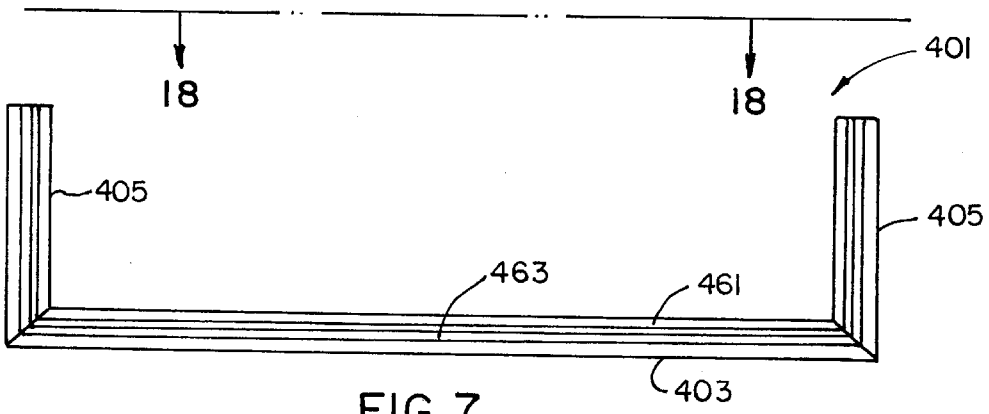
FIG. 7 is a front elevational view of a wall mounted frame adapted to receive a sign from the top.
Figure 8:
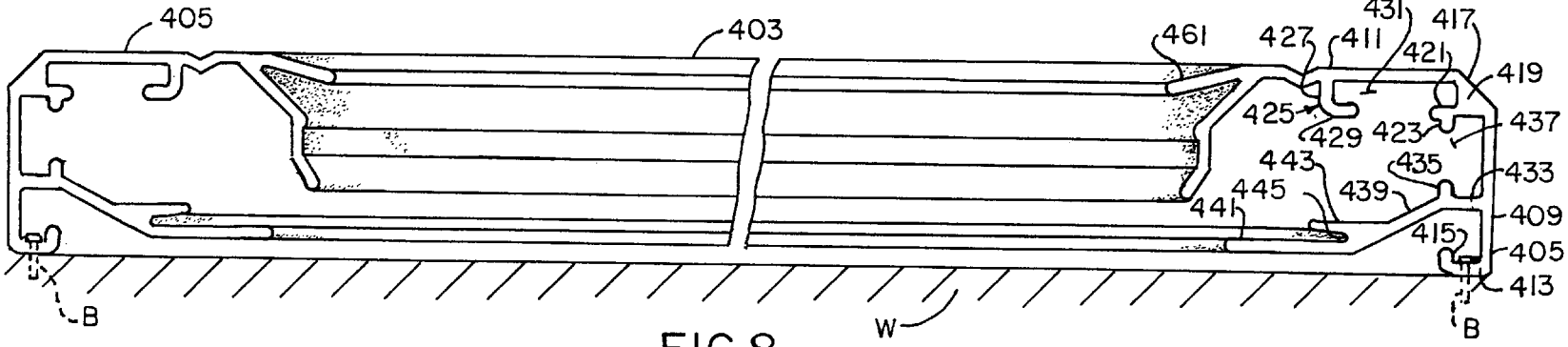
FIG. 8 is a top plan view of the frame of FIG. 7.

A third embodiment of the frame is shown in FIGS. 7–8 and is designed to be mounted to a wall W. The frame 401 is a three sided frame and is shown to have a bottom 403 and sides 405 extending up from opposite ends of the base 403. In this embodiment, wherein the sign receiving side is open, the three remaining sides are made from a single extrusion 407 which is cut to pieces of the appropriate length and then assembled.

Figure 9:
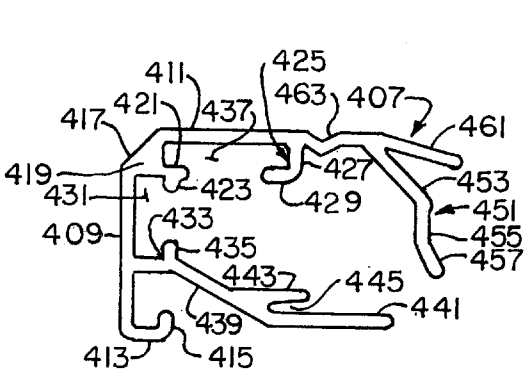
FIG. 9 is an end view of a member used to form the frame of FIG. 7.

The extrusion 407 is shown in detail in FIG. 9. The extrusion includes a side surface 409 and a front surface 411. A small leg 413 having an upturned end 415 extends inwardly from the back of the side 409 and is adapted to receive bolts B or the like to mount the frame 401 to the wall W. The front surface 411 extends parallel to the wall W, when the frame is mounted to the wall. The front and back surfaces are joined by a chamfered corner 417 having a bead 419 along its inside. Two perpendicular ribs 421 and 423 extend from the end of the bead 419. An L-shaped rib 425 having a leg 427 and finger 429 extends the length of the extrusion. The finger 429 is coplanar with the rib 421, and the rib 421, finger 429, and side 411 cooperate to define a channel 431 which receives the connector 15 to connect the frame pieces together to assemble the frame.

A generally planar surface 433 extends inwardly from side 409 and has a rib 435 at its end. The rib 435 faces, and is coplanar with, the rib 423. The ribs 423 and 435 and the side 409 define a second channel 437. Connectors may be provided to be inserted in the channels 437 to connect the frame elements together via the channels 437 either in lieu of or in addition to the channels 431.

A sloped surface 439 extends rearwardly and inwardly from the end of the surface 433. A back leg 441 is formed at the end of the surface 439 to extend generally parallel to the front surface 411. A second, upper, ledge 443 extends from the surface 439 above the ledge 441. The ledges 441 and 443 are spaced apart and define a sign receiving channel 445. The surface 439 is of a length such that the sign will be spaced from the wall W when the sign is placed in the frame.

A finger 451 extends inwardly and rearwardly from the end of the front surface 411 and ends forwardly of the finger 443. The finger 451 is made of three surfaces: a first surface 453 which extends forwardly and rearwardly from the end of the surface 411; a second surface 455 which extends from the end of the surface 455 generally parallel to the side 409: and a third surface 457 which extends from the end of surface 457 inwardly and rearwardly. The end of the finger 451 is spaced inwardly and upwardly from the fingers 441 and 443, as can be seen in FIGS. 18 and 19. When a sign is placed in the frame 401, the sign will be received in the channel 445, and the finger 451 will prevent the sign from falling forwardly out of the frame.

A sloped surface 461 extends from the end of front surface 411 to give the frame a finished look. The surface 461 extends over the finger 451 so that the finger 451 cannot be seen when the frame is viewed in elevation. Lastly, a V-shaped groove 463 is formed in the front surface 411 of the frame.

The frame 401 is assembled using connectors 15, much in the same way the frames 1 and 201 are assembled. When the sign is assembled, it will have an open side which receives the frame. As can be see from FIG. 18, the open side leaves the channel 445 exposed. Thus, the sign is simply slid into the channel 445 to place a sign therein.

As variations within the scope of the appended claims may be apparent to those skilled in the art, the foregoing description is set forth only for illustrative purposes and is not meant to be limiting. For example, although the various frame members are preferably formed as extrusions so that they may be selectively cut to length, the frame members may also be molded in specific desired lengths. This example is merely illustrative.

We claim:

1. A sign frame for receiving at least one sign, the frame having a first side, a second side, a third side, and a fourth side, and each of said sides forming a base;

said second, third, and fourth sides being formed from elongate members which are connected together to form three sides of the frame, said elongate members being generally tubular and having a sign receiving channel formed along one side which is for receiving at least one sign;

a stiffening member being inserted within at least one side for securement within the frame;

said first side defining a sign receiving opening;

said first side being made of a front member and a back member, said front and back members being identical, said first side, front and back members and said second, third and fourth side elongate members being sized such that said front and back members are spaced apart from each other to define said sign receiving opening of the sign frame;

said stiffening member having a bead and a plate extending from said bead, one of said second, third and fourth sides having an elongate central beam, an elongate tube on a top surface of said beam which has a longitudinal opening to define a generally C-shaped channel, and spaced apart surfaces extending from said tube generally perpendicular to said base of said one side, said spaced apart surfaces defining said sign receiving opening, said stiffening member bead being sized to be received and locked in said C-shaped channel, said plate extending out of said C-shaped channel and through said sign receiving channel, whereby said stiffening member upon installation being locked within said sign frame for retaining said sign for display within said sign frame.

2. The sign frame of claim 1 wherein said elongate members each have connector receiving channels formed therein, angled connectors being insertable in said connector receiving channels to fixedly connect said elongate members together, said connectors having a first leg which is received in one member and a second leg which is received in a second member, said legs each having a barb, said bard and said connector receiving channels being sized such that said connector is force fit in said connector receiving channel.

3. The sign frame of claim 1 wherein, sides extend from said base of each of said second, third, and fourth side member, and a front extending between said sides, a first pair of spaced apart elongate ribs extending up from said base and defining said sign receiving channel, said front having an elongate opening aligned with said sign receiving channel.

4. The sign frame of claim 3 wherein one of said second, third, and fourth sides define a bottom of said sign frame, said member forming said sign frame bottom having a footing and having flanges extending outwardly from said first pair of ribs towards said sides.

5. A sign frame for receiving at least one sign, the frame having a first side, a second side, a third side, and a fourth side;

said second, third, and fourth side being formed from elongate members which are connected together to form three sides of the frame, said elongate members being generally tubular and having a sign receiving channel formed along one side which is for receiving at least one sign;

a stiffening member being inserted within at least one side for securement within the frame;

said first side defining a sign receiving opening;

said first side being made of a front member and a back member, said front and back members being identical, said first side front and back members and said second, third, and fourth side elongate members being sized such that said front and back members are spaced apart from each other to define said sign receiving opening of said sign frame;

said second, third, and fourth side members each having a base, sides extending from said base, and a front extending between said sides, a first pair of spaced apart elongate ribs extending up from said base and defining said sign receiving channel, said front having an elongate opening aligned with said sign receiving channel;

said second, third and fourth side members each having second pairs of ribs spaced from said sides, said second pair ribs including a bottom rib extending upwardly from said base and an upper rib extending downwardly from said front, said bottom and upper ribs being coplanar with each other, said bottom and upper rib, and said member side, in combination, defining a channel for receiving a connector to secure said members together to assemble said sign frame.

6. The sign frame of claim 5 wherein said front of said second, third, and fourth members include a first portion which is generally parallel to said base, and a second portion which extends inwardly from an end of said first portion and away from said base.

7. The sign frame of claim 6 wherein said second, third, and fourth members have an axis of symmetry which divides said members into a front half and a back half, said first side members having a base, a side extending from said base, and a front extending from said side, said base, side, and front of said first side member being substantially identical to one-half of said first, second, and third side members.

8. A sign frame for receiving at least one sign, the frame having a first side, a second side, a third side and a fourth side;

said second, third, and fourth sides being formed from elongate members which are connected together to form three sides of said frame, said elongate members being generally tubular and having a sign receiving channel formed along one side which is for receiving at least one sign;

a stiffening member being inserted within at least one side for securement within the frame;

said first side defining a sign receiving opening;

said first side being made of a front member and a back member, said front and back members being identical, said first side, front and back members and said second, third and fourth side elongate members being sized such that said front and back members are spaced apart from each other to define said sign receiving opening of said sign frame;

said second, third and fourth sides are made from substantially identical elongate members, the members having a base, sides, and a front; said base having an elongate central beam, an elongate tube on a top surface of said beam which has a longitudinal opening to define a generally C-shaped channel, and spaced apart surfaces extending from said tube generally perpendicularly to said base, said spaced apart surfaces defining said sign receiving channel, said front of said member extending from said member sides to said spaced apart surfaces, said front having an elongate opening therein which opens into said sign receiving channel.

9. The sign frame of claim 8 including a stiffener member, said stiffening member having a bead at a base thereof and a plate extending from said bead, said bead being sized to be received in said C-shaped channel, said plate extending out of said C-shaped channel and through said sign receiving channel.

10. The sign frame of claim 9 wherein said stiffening member divides said sign receiving channel into a front channel and a back channel, each said channel being sized to receive a sign.

11. The sign frame of claim 10 wherein said member which forms said second, third and fourth sides has an axis of symmetry which divides said member into a front half and back half, said first side members having a base, a side extending from said base, and a front extending from said side, said base, side, and front of said first side member being substantially identical to one-half of said first, second and third side member.

* * * * *